US005302932A

United States Patent [19]

Person et al.

[11] Patent Number: 5,302,932

[45] Date of Patent: Apr. 12, 1994

[54] MONOLYTHIC MULTILAYER CHIP INDUCTOR AND METHOD FOR MAKING SAME

[75] Inventors: Herman R. Person; Scott D. Zwick; Thomas L. Veik; Joseph F. Hesse, all of Columbus, Nebr.

[73] Assignee: Dale Electronics, Inc., Columbus, Nebr.

[21] Appl. No.: 881,856

[22] Filed: May 12, 1992

[51] Int. Cl.[5] ..... H01F 5/00

[52] U.S. Cl. ..... 336/200; 336/232

[58] Field of Search ..... 336/200, 232

[56] References Cited

U.S. PATENT DOCUMENTS

| | | | |
|---|---|---|---|
| 3,798,059 | 3/1974 | Astle et al. | 117/212 |
| 3,812,442 | 5/1974 | Muckelroy | 336/83 |
| 4,322,698 | 3/1982 | Takahashi et al. | 333/184 |
| 4,543,553 | 9/1985 | Mandai et al. | 336/200 X |
| 4,689,594 | 8/1987 | Kawabata et al. | 336/200 |
| 4,731,297 | 3/1988 | Takaya | 428/553 |
| 4,746,557 | 5/1988 | Sakamoto et al. | 428/138 |
| 4,754,242 | 6/1988 | Okamura et al. | 333/175 |
| 4,959,631 | 9/1990 | Hasegawa et al. | 336/83 |
| 4,999,597 | 3/1991 | Gaynor | 333/246 |
| 5,014,024 | 5/1991 | Shimizu et al. | 333/203 |
| 5,014,026 | 5/1991 | Wanjura | 333/185 |
| 5,015,972 | 5/1991 | Cygan et al. | 333/32 |
| 5,032,810 | 7/1991 | Kaneko et al. | 333/185 |
| 5,032,815 | 7/1991 | Kobayashi et al. | 336/83 |
| 5,034,709 | 7/1991 | Azumi et al. | 333/184 |
| 5,034,710 | 7/1991 | Kawaguchi | 333/185 |
| 5,034,717 | 7/1991 | Shinkai | 336/223 |
| 5,039,964 | 8/1991 | Ikeda | 333/181 |
| 5,045,380 | 9/1991 | Kobayashi et al. | 428/195 |
| 5,051,712 | 9/1991 | Naito et al. | 333/185 |

FOREIGN PATENT DOCUMENTS

| | | | |
|---|---|---|---|
| 96710 | 6/1983 | Japan | 336/200 |
| 102215 | 5/1988 | Japan | 336/200 |
| 2-135715 | 5/1990 | Japan | 336/200 |
| 4-111405 | 4/1992 | Japan | 336/200 |

*Primary Examiner*—Leo P. Picard
*Assistant Examiner*—L. Thomas
*Attorney, Agent, or Firm*—Zarley, McKee, Thomte, Voorhees, & Sease

[57] ABSTRACT

A monolythic multilayer chip inductor includes a plurality of subassemblies stacked one above another. Each of the subassemblies includes a ferrite layer having a coil conductor printed on its upper surface. All of the ferrite layers except for the bottom layer and a ferrite top cap include via holes therein for permitting interconnection of the electrical interconnection of the conductor coils from one layer to the other. One end of the top coil conductor is exposed adjacent the edge of the chip, and one end of the bottom coil conductor is exposed adjacent another edge of the chip so that the conductors can be connected to terminals for introducing electrical current which will pass through all of the interconnected coils.

11 Claims, 2 Drawing Sheets

MONOLYTHIC MULTILAYER CHIP INDUCTOR AND METHOD FOR MAKING SAME

BACKGROUND OF THE INVENTION

The present invention relates to a monolythic multilayer chip inductor and method for making same.

Monolythic multilayer chip inductors exist in the prior art, but there is a need for such an inductor which can be easily manufactured in large quantities, and which provides an improved reliability in operation.

Therefore, a primary object of the present invention is the provision of an improved monolythic multilayer chip inductor and method for making same.

A further object of the present invention is the provision of an improved monolythic multilayer chip inductor having a plurality of conductor coils stacked above one another and sandwiched between ferrite layers, and having end cap terminals at opposite edges thereof.

A further object of the present invention is the provision on an improved monolythic multilayer chip inductor which can be manufactured in large quantities on a single sheet of material, later to be cut apart into individual inductors.

A further object of the present invention is the provision of an improved method for making a monolythic multilayer chip inductor which permits the coils to be precisely registered and centered above one another from one layer to the other.

A further object of the present invention is the provision of an improved monolythic multilayer chip inductor and method for making same which is simple in construction, easy to manufacture, and efficient and reliable in operation.

SUMMARY OF THE INVENTION

The monolythic multilayer chip inductor of the present invention includes a plurality of subassemblies stacked upon one another. At the bottom is a bottom subassembly including a bottom ferrite layer and a bottom coil inductor printed on the bottom ferrite layer. The bottom coil conductor includes a first end adjacent the front edge of the bottom ferrite layer and a second end located spaced inwardly from the first edge of the bottom ferrite layer. Additional subassemblies may be printed above the bottom subassembly. Each of these additional subassemblies includes a ferrite layer having a via opening extending therethrough and having a coil conductor printed on the top surface thereof. Each coil conductor includes a first end registered with a via opening in the ferrite layer below it and a second end registered with a via opening in the ferrite layer above it.

The ends of the coils are interconnected through the via openings by means of conductors within the via openings. The preferred conductor is a silver filler material which is printed over each via opening in order to fill up the via opening and provide electrical connection between the two coils above and below the via opening.

A top subassembly is printed at the very top of the stack of subassemblies, and includes a top ferrite layer having a via opening extending therethrough and a top coil conductor above the top ferrite layer. The top coil conductor has a first end registered with the via opening and connected to the coil there below by means of a conductive filler within the via opening. The top coil also has a second end located adjacent one of the edges of the top subassembly and adjacent and above a second edge of the bottom ferrite layer of the bottom subassembly. This arrangement permits a pair of end caps or terminals to be provided over the inductor, with one of the end caps being in electrical contact with the first end of the bottom coil conductor and with the other of the terminals being in contact with the second end of the top coil conductor. A top cap ferrite layer is printed in covering relation over the top subassembly.

The present invention can be constructed in multiples by the method of the present invention. Initially, a sheet of material made of mylar or other material having a lower coefficient of adhesion is covered with a ferrite bottom layer. Next, a plurality of first conductor coils are printed on top of the ferrite bottom layer. In the next step, a second ferrite layer is printed over the first conductor coils and includes a plurality of via opening therein each registered with the output ends of a first coil conductor. These via openings are then filled with a silver filler, and a group of second conductor coils are printed over the second ferrite layer, with one end of each of the second conductor coil being located in registered alignment with one of the via openings in the second ferrite layer.

Additional groups of subassemblies are printed over one another in the same fashion as described above until a top set of coil conductors are printed over a top ferrite layer. In addition to the printing of the top coil conductors, a plurality of cutting marks are printed on the top ferrite layer along the edges thereof so as to mark the appropriate places for cutting the various coils apart. Finally, a ferrite top cap is printed over all of the top coil conductors. The top cap includes a plurality of cutting line windows which are registered with the cutting lines marked there below. This permits visual alignment of a cutting saw with the cutting marks along the edges of the laminated conductor assembly.

The entire assembly is then peeled off of the mylar material and set on an alumina carrier for sintering. Sintering occurs at approximately 900° centigrade in a furnace for approximately two hours with careful attention being given to the burn out of the organic binders within the component so as to prevent blisters and cracks.

Following the firing process, the assembly or wafer is removed from the alumina carrier, mounted onto a holder, and is diced into individual chip inductors with a precision diamond blade dicing saw commonly used in the semiconductor industry. The saw blade is aligned with the saw alignment marks which can be seen through the cutting line windows of the top cap.

After completion of cutting the assembly into individual inductor assemblies or wafers, the bottom termination of the bottom coil conductor and the top termination of the top coil conductor are the only two conductor features exposed at the edges of the completed inductor assembly. All of the rest of the conductor coils are completely encased within the laminations of ferrite. Furthermore, the coils are centered with respect to the ferrite layers as viewed in plan view.

Terminations are then attached to different edges of the completed inductor (preferably opposite edges), with one of the terminations in electrical contact with the output end of the top coil conductor and with the other of the terminations in electrical contact with the input end of the bottom coil conductor.

DETAILED DESCRIPTION OF THE PREFERRED EMBODIMENT

Figures 1, 2, 3:
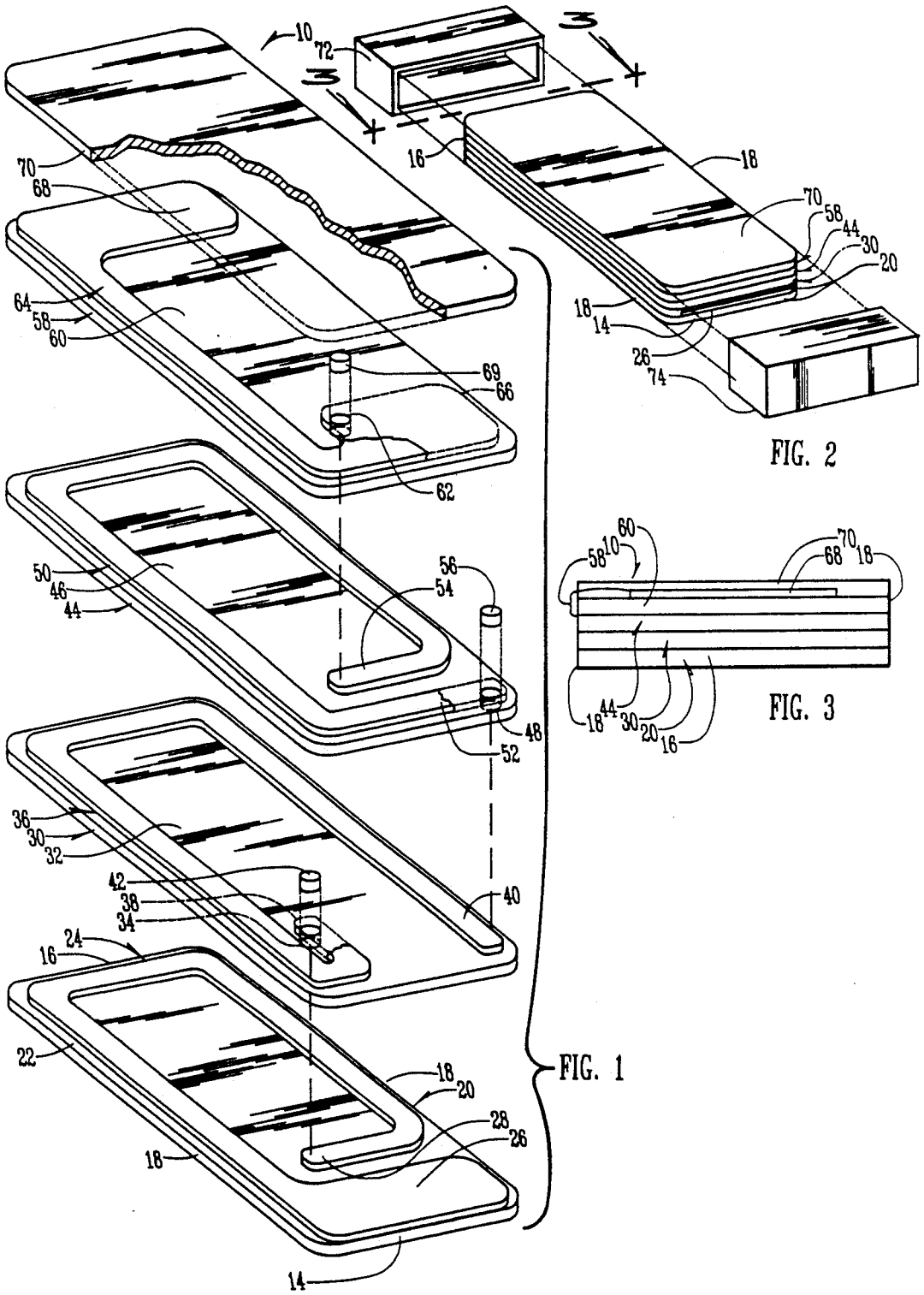
FIG. 1 is an exploded perspective view of the inductor of the monolythic multilayer chip inductor of the present invention.
FIG. 2 is a perspective view of the assembled monolythic multilayer chip inductor showing the terminations in exploded view.
FIG. 3 is a side elevational view taken along line 3—3 of FIG. 2.

Referring to the drawings, the numeral 10 generally designates the monolythic multilayer chip inductor of the present invention. Inductor 10 comprises a plurality of subassemblies stacked upon one another. A bottom subassembly 20 includes a ferrite bottom layer 22 and a bottom coil conductor 24 printed over ferrite layer 22 and having an outer end 26 and an inner end 28. Bottom ferrite layer 22 includes a front edge 14, a rear edge 16, and a pair of opposite side edges 18. End 26 of coil conductor 24 is positioned flush with the front edge 14 of bottom ferrite layer 22. This causes the outer end 26 of coil conductor 24 to be exposed when the assembly is complete. The remainder of bottom coil 24 is located inwardly from the opposite edges 18 and the rear edge 16 of bottom ferrite layer 22.

Printed over the bottom subassembly 20 is a first intermediate subassembly 30. Subassembly 30 includes a first intermediate ferrite layer 32 having a via hole 34 extending therethrough. Via hole 34 is registered immediately above the inner coil end 28 of bottom conductor coil 24.

Printed over the upper surface of first intermediate ferrite layer 32 is a first intermediate coil conductor 36 having an inner end 38 registered over via hole 34 and having an outer end 40. Outer end 40 is spaced inwardly from the front edge 14 of subassembly 20 in contrast to the outer end 26 of bottom coil conductor 24.

Each ferrite layer in the present invention is preferably printed in several multiple prints until the total dry thickness of each ferrite layer is approximately 25 microns thick. Other thicknesses may be used without detracting from the invention. However, the thickness of each ferrite layer requires that the via hole 34 be filled with a conductive filler 42 which provides electrical connection between the inner end 38 of first intermediate coil 36 and the inner end 28 of bottom coil 24.

Printed above first intermediate subassembly 30 is a second intermediate subassembly 44 having a second ferrite layer 46 formed with a via hole 48, and having a second intermediate coil conductor 50 printed on the second intermediate ferrite layer 46. Second intermediate coil conductor 50 has a outer end 52 registered above via hole 48. Via hole 48 is filled with a conductive filler 56, and is registered above the outer coil end 40 of first intermediate coil 36. Thus, the filler 56 provides electrical connection between the outer coil end 40 of first intermediate coil 36 and the outer coil end 52 of second intermediate coil 50. Second intermediate coil 50 also includes an inner end 54. The entire second intermediate coil 50 is positioned inwardly from the parametric edges of second intermediate ferrite layer 46.

Printed above second intermediate subassembly 44 is a top subassembly 58 which comprises a top ferrite layer 60 having a via hole 62 extending therethrough and a top coil conductor 64 printed over the upper surface of top ferrite layer 60. Top coil conductor 64 includes a top inner coil end 66 which is registered above the via hole 62 and includes a top outer coil end 68 which extends flush with the rear parametric edge of top ferrite layer 60 and which is also registered above the rear edge 16 of bottom ferrite layer 22. A conductive filler 69 is within via hole 62 and provides electrical connection between the top inner coil end 66 and the inner coil end 54 of second intermediate coil conductor 50.

A ferrite top cap layer 70 is printed over the top subassembly 58 and covers the top subassembly 58. However, the outer coil end 68 of top conductive coil 64 is exposed between the edges of top ferrite layer 60 and the top cap 70.

When the assembly is complete, a continuous electrical path is provided commencing with outer end 26 of bottom coil conductor 24 and passing through the inner end 28 thereof, through first filler 42 to the inner coil end 38 of first intermediate coil conductor 36. The electrical path continues to outer coil end 40 through second filler 56, outer coil end 52, inner coil end 54, third filler 69, inner coil end 66, and outer coil end 68. It should be noted that the electrical path continues in the same rotational direction (clockwise as shown in FIG. 1) from the bottom coil conductor 24 upwardly through the top coil conductor 64. Any desired number of intermediate coil subassemblies 30, 44, may be printed, or the inductor can be made with only the top subassembly 58 and the bottom subassembly 20, depending upon the particular values of inductance which are required.

Referring to FIG. 2, a pair of end terminals 72, 74 are mounted or printed over the front and rear edges of 14, 16 of assembly 10. Terminals 72, 74 can be metallic end caps, or they can be printed conductive material which is printed over the front and rear edges of the inductor 10. Terminal 72 is in electrical contact with the outer end 68 of top coil conductor 64, and terminal 74 is in electrical contact with the outer end 26 of bottom coil conductor 24.

Figure 4:
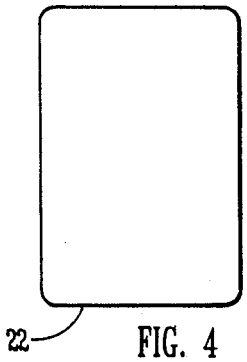
FIGS. 4–15 are views showing the various printing stages of the process for making the present invention.
Figure 5:
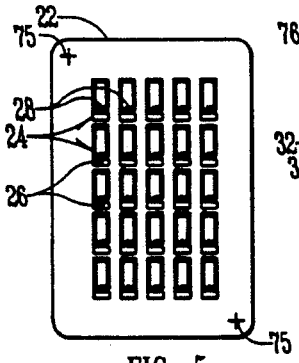
Figure 6:
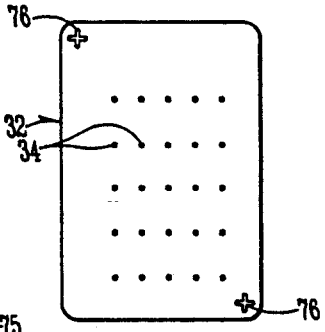
Figure 7:
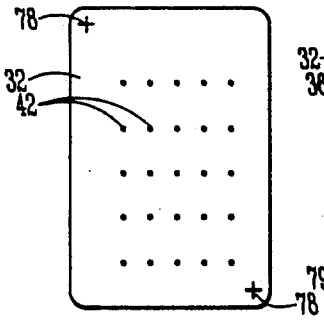
Figure 8:
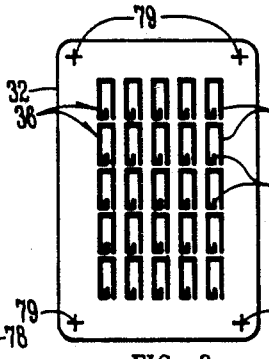

While the resulting monolythic multilayer chip inductor 10 is shown in FIGS. 1–3, a method for producing a plurality of inductors 10 is shown in FIGS. 4–15. In these figures, numerals are used which correspond to the numerals used for similar parts in FIGS. 1–3. Referring to FIG. 4, using a suitable adhesive for microelectronics, a thick mylar sheet of material, 2 inches by 2 inches by 0.010 inches thick (not shown) is attached to the upper surface of a soda lime glass substrate (not shown). Other than mylar, polyethylene, plastic, or any other material having a low coefficient of adhesion may be used. The top surface of this mylar substrate is painted with polyvinyl alcohol or the like, as a release agent. The polyvinyl alcohol is permitted to dry.

Over the mylar is then printed the ferrite base or bottom cap 22 shown in FIG. 4.

After the ferrite bottom cap 22 is printed, a plurality of conductor coils 24 (FIG. 5) are printed over bottom cap 22. The outer ends 26 of coils 24 are wider than the remainder of the coils 24, and the plurality of printed coils 24 are centered over bottom cap 22. Also, a pair of silver crosses 75 are printed over ferrite layer 22.

Following the printing of the coils 24, a first intermediate ferrite layer 32 is printed over the coils 24 and includes a plurality of via holes 34 which are in registered alignment over the inner ends 28 of coils 24. Crosses 75 are aligned with the pair of open cross windows 76 in first intermediate ferrite layer 32 so as to permit proper registration of layer 32 with respect to coils 24.

Next, a plurality of first fillers 42 are printed over the ferrite layer 32 and are in registered alignment with and fit within the via holes 34 so as to completely fill them. Crosses 78 are printed over crosses 75 which are registered with cross windows 76.

Next, a plurality of first intermediate coil conductors 36 are printed over first intermediate ferrite layer 32 and are properly aligned so that the inner ends 38 fit over via openings 34 and are in electrical contact with first fillers 42. At the same time four crosses 79 are printed on the four corners of ferrite layer 32.

Figure 9:
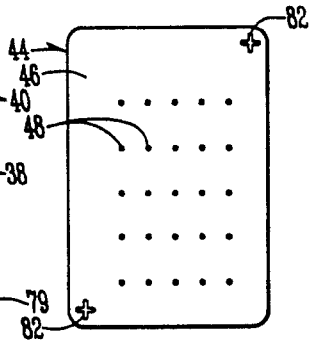
Figure 10:
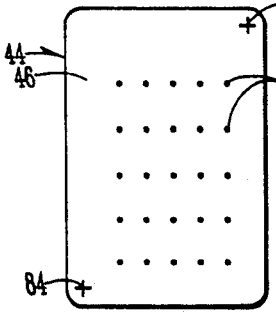
Figure 11:
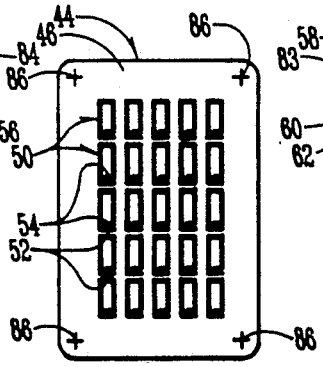

Additional intermediate subassemblies may be assembled as desired, and FIGS. 9–11 illustrate a second intermediate subassembly 44. A second intermediate ferrite layer 46 (FIG. 9) is printed over subassembly 30 and includes via holes 48, and cross windows 82 registered over crosses 79. In FIG. 10 conductive fillers 56 are printed over via openings 48 and crosses 84 are printed over windows 82. In FIG. 11 coil conductors 50 and four crosses 86 are printed over ferrite layer 46.

Figure 12:
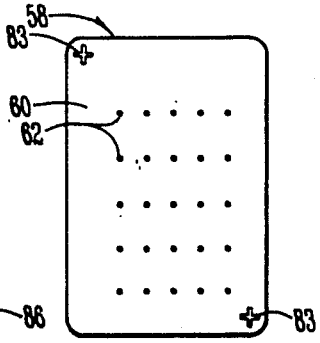
Figure 13:
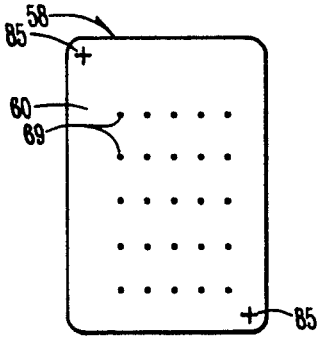
Figure 14:
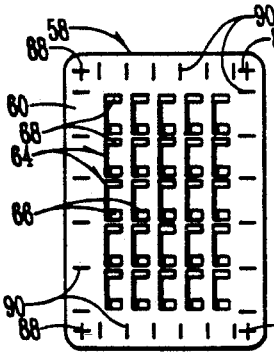
Figure 15:
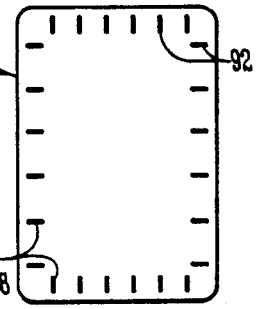

The final subassembly or top subassembly 58 is shown in FIGS. 12 through 14 and includes the top ferrite layer 60 having via holes 62 therein. The ferrite layer 60 is provided with cross windows 83 which are alligned with two of the crosses 86. In FIG. 13 conductive fillers 69 and crosses 85 are printed over ferrite layer 60. In FIG. 14 conductive coils 64 and four crosses 88 are added. The top coil conductors 64 have outer ends 68 which are of enlarged thickness and which are positioned adjacent the rear edges of the individual inductors 10 to be formed. Coil conductors 64 also have inner ends 66. The alignment of the various layers in FIGS. 5–14 is accomplished by means of cross windows 76, 82, 83 and aligning crosses 75, 78, 79, 84, 85, 86, and 88 respectively.

In FIG. 14 a plurality of cutting lines 90 are printed around the periphery of the group of top coils 64 so as to permit the alignment of the final ferrite top cap 70 which has a plurality of cutting line windows 92. Windows 92 are registered with the cutting lines 90 so as to provide proper registration of the top cap 70 with respect to the remainder of the assembly, and so as to expose the cutting lines 90 after the assembly is complete.

The assembly after drying is then peeled off of the mylar substrate and set on an alumina substrate (not shown) for sintering. The sintering occurs at 900° centigrade in a box furnace for two hours with careful attention being given to the burnout of the organic binders and the prevention of blisters and cracks.

Following the firing process, the wafer is mounted onto a wafer holder and then is diced into individual chip inductors with a precision diamond blade dicing saw commonly used in the semiconductor IC industry. The saw blade is aligned with the saw alignment marks 90 so that the cut occurs along the thickened portions 68 of coils 64, and along the thickened ends 26 of bottom coils 24. These are the only two portions of any of the coil conductors which are exposed by the diamond cuts through the assembly. All other portions of bottom and top coils 24, 64, and all of the intermediate coils 36, 50 are completely enclosed by the laminated ferrite layers. If properly aligned before the cutting process, each coil is centered with respect to a plan view of the resulting inductor 10.

After inspection of each of the individual coils 10, the end conductors 72, 74 are attached. These end terminals are preferably a multilayer structure including a silver termination, a nickel-plated end cap, and a tin lead plating over the end cap.

The present invention provides a simple, efficient, and reliable method of production of the monolythic multilayer chip inductors 10.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. A monolythic multilayer chip inductor comprising:

a laminated bottom subassembly comprising a bottom ferrite layer and a bottom coil conductor on said bottom ferrite layer, said bottom ferrite layer having a top surface, a front edge, a rear edge, and opposite side edges;

said bottom coil conductor having a top face and having a first end adjacent said front edge of said bottom ferrite layer and having a second end spaced inwardly from said front, rear, and opposite side edges of said bottom ferrite layer;

a laminated top subassembly comprising a top ferrite layer having a top via opening extending therethrough and a top coil conductor on said top ferrite layer;

said top coil conductor having a bottom face and having a first end registered and in substantially covering relation with said top via opening of said top ferrite layer and having a second end above one of said rear and opposite side edges of said bottom ferrite layer;

columnar conductor means electrically connecting said top face adjacent to said second end of said bottom coil conductor to said bottom face at said first end of said top coil conductor through said top via opening in said top ferrite layer;

a ferrite top cap printed in covering relation over said top coil conductor;

first and second terminal means;

said first end of said bottom coil conductor being exposed from between said bottom ferrite layer and said top ferrite layer and being electrically connected to said first terminal means; and said second end of said top coil conductor being exposed from between said top ferrite layer and said top cap, and being electrically connected to said second terminal means.

2. A monolythic multilayer chip inductor according to claim 1 wherein said conductor means comprises an electrically conductive material filling said top via opening.

3. A monolythic multilayer chip inductor according to claim 1 wherein said conductor means comprises at least one intermediate subassembly sandwiched between said top subassembly and said bottom subassembly, said one intermediate subassembly comprising an intermediate ferrite layer having an intermediate via opening extending therethrough and an intermediate conductor coil on said intermediate ferrite layer.

4. A monolythic multilayer chip inductor according to claim 3 wherein said intermediate coil conductor includes a first coil end overlying said intermediate via opening and a second coil end positioned under said top via opening.

5. A monolythic multilayer chip inductor according to claim 4 wherein said conductor means further comprises a conductive top filler filling said top via opening and a conductive intermediate filler filling said intermediate via opening.

6. A monolythic multilayer chip inductor according to claim 5 wherein said top filler forms an electrical connection between said second coil end of said intermediate coil conductor and said first end of said top coil conductor.

7. A monolythic multilayer chip inductor according to claim 6 wherein said intermediate filler forms an electrical connection between said first end of said intermediate coil conductor and said second end of said bottom coil conductor.

8. A monolythic multilayer chip inductor according to claim 4 wherein said intermediate coil conductor is sandwiched between and completely encased by said intermediate ferrite layer and said top ferrite layer.

9. A monolythic multilayer chip inductor according to claim 8 wherein said intermediate and top ferrite layers in top plan view have the same shape and size and are registered with one another, said intermediate coil conductor being in plan view centered with respect to said intermediate and top layers.

10. A monolythic multilayer chip inductor according to claim 1 wherein said columnar conductor means is printed through said top via opening in said top ferrite layer.

11. A monolythic multilayer chip inductor according to claim 1 wherein said bottom coil conductor winds around on said top surface of said bottom ferrite layer by turning at least 360 degrees in one direction.

* * * * *